United States Patent [19]

Takahashi et al.

[11] 4,433,706

[45] Feb. 28, 1984

[54] WEFT INSERTING NOZZLE OF AN AIR JET TYPE WEAVING LOOM

[75] Inventors: Takao Takahashi; Kimimasa Ohnishi; Sinzi Wakai, all of Tokyo, Japan

[73] Assignee: Nissan Motor Co., Ltd., Yokohama, Japan

[21] Appl. No.: 306,299

[22] Filed: Sep. 28, 1981

[30] Foreign Application Priority Data

Oct. 15, 1980 [JP] Japan ..... 55-142927

[51] Int. Cl.[3] ..... D03D 47/30

[52] U.S. Cl. ..... 139/435

[58] Field of Search ..... 139/435; 226/97

[56] References Cited

U.S. PATENT DOCUMENTS 4,347,872 9/1982 Brouwer et al. ..... 139/435
4,353,397 10/1982 Tera et al. ..... 139/435

FOREIGN PATENT DOCUMENTS 19784 12/1980 European Pat. Off. .
23929 2/1981 European Pat. Off. ..... 139/435
934535 8/1963 United Kingdom .
1213992 11/1970 United Kingdom .
1289013 9/1972 United Kingdom .
1459707 12/1976 United Kingdom .
1544484 4/1979 United Kingdom .
2012322 7/1979 United Kingdom .

OTHER PUBLICATIONS

Journal of the Textile Machine Society of Japan, Jul. 1961, A Study on Air-Jet Looms, Minoru Uno et al.

*Primary Examiner*—Henry Jaudon
*Attorney, Agent, or Firm*—Schwartz, Jeffery, Schwaab, Mack, Blumenthal & Koch

[57] ABSTRACT

A weft inserting nozzle including a weft inserting first hole through which a weft yarn is passed, an annular air jet opening defined around the exit of the first hole, and a weft inserting second hole extending coaxially and downstream from the annular air jet opening is disclosed. The second hole consists of an upstream positioned first section and a downstream positioned second section each having a uniform diameter throughout the length thereof, the diameter of the second section being greater than that of the first section which is equal to the outer diameter of the annular air jet opening.

1 Claim, 3 Drawing Figures

WEFT INSERTING NOZZLE OF AN AIR JET TYPE WEAVING LOOM

BACKGROUND OF THE INVENTION

1. Field of the Invention

The present invention relates in general to a weft picking device for an air jet type weaving loom in which a weft yarn is adapted to be blown into the warp shed by means of air jet action, and more particularly to an improvement in a weft inserting nozzle of the weft picking device.

2. Description of the Prior Art

Many types of weft inserting nozzles are known and used in the field of air jet type weaving looms. One of them is of a type comprising generally a weft inserting tube through which is passed a weft yarn, with a first chamber section coaxially surrounding the tube to form an annular air jet opening about the tip of the tube, and a second chamber section extending coaxially and downstream from the air jet opening. In this type of nozzle, there are two ways for increasing the traction force applied to the weft yarn for the weft yarn picking. One is to increase the velocity of air ejected or jetted from the air jet opening and the other is to increase the longitudinal length of the second chamber station. The former technique sometimes causes an easy breakage of the weft yarn because of difficulty in setting the air velocity at the optimum value. Thus, it is generally recognized that the latter way is more practical.

However, increasing the longitudinal length of the second chamber section tends to bring about a slack of the weft yarn in the nozzle, originating from a difference in traction force between the force applied to the weft yarn within the nozzle and the force applied to the weft yarn just issued from the nozzle. In fact, while flowing through the elongated second chamber section, the air is gradually accelerated steadily pulling the weft yarn out of the weft inserting tube. Upon ejection from the nozzle, this air collides against the surrounding air thus reducing its velocity, so that the weft yarn issuing from the nozzle decreases its velocity. Thus, the weft yarn in the second chamber section is subjected to contraction, producing the undesired slack. Further, increasing the longitudinal length of the coaxial downstream chamber tends to cause the weft yarn in the nozzle to untwist, especially when it is exposed to a high velocity air throughout a long length thereof. Furthermore, this technique induces a possibility of back flow of air toward the first chamber section, which of course prevents the weft yarn from being optimally picked into the warp shed.

SUMMARY OF THE INVENTION

Therefore, it is an essential object of the present invention to provide an improved weft inserting nozzle which is free of the above-mentioned problems.

According to the present invention, there is provided a weft inserting nozzle for an air jet type weaving loom. The nozzle comprises a weft inserting first hole through which a weft yarn is adapted to pass, means defining around the exit of the first hole an annular air jet opening from which a pressurized air is ejected downstream for drawing the weft yarn out from the first hole, and means defining a weft inserting second hole which coaxially and downstream extends from the annular jet opening. The second hole consists of an upstream first section and a downstream second section each having a uniform diameter throughout its length, the diameter of the second section being greater than that of the first section.

DETAILED DESCRIPTION OF THE INVENTION

Figure 1:
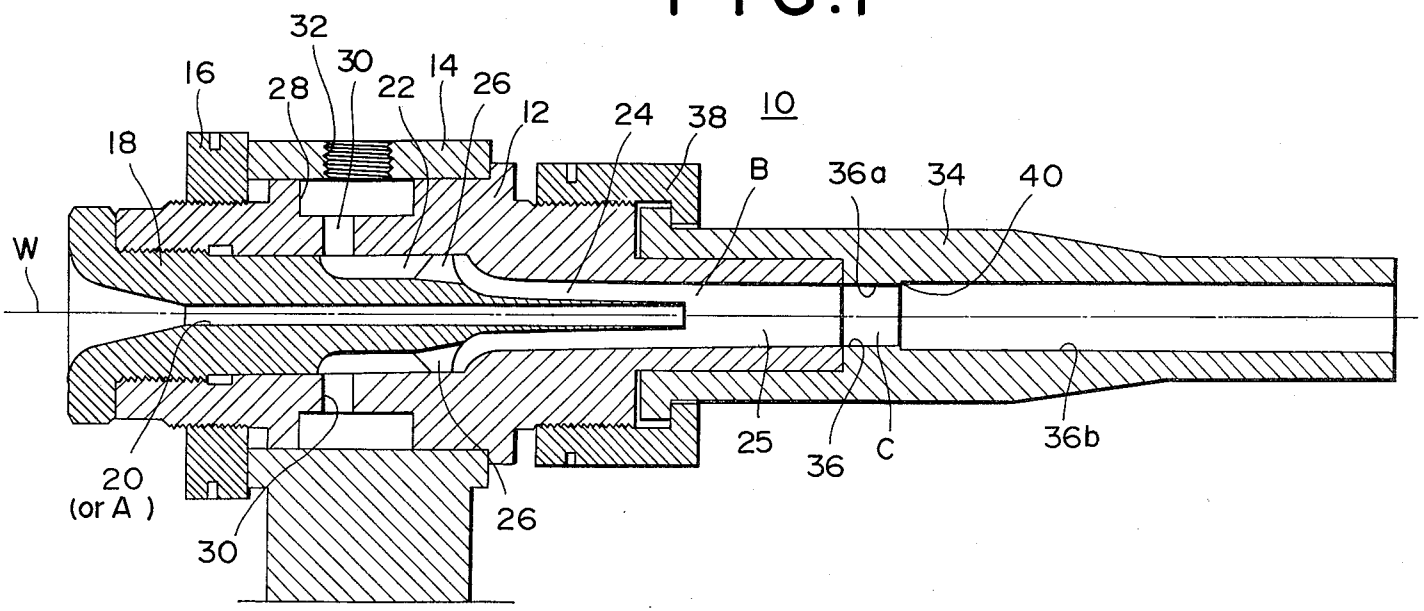
FIG. 1 is a sectional view of a weft inserting nozzle, which is a first embodiment of the present invention.

Referring to FIG. 1 of the drawings, there is shown a first embodiment of the present invention.

The weft inserting nozzle 10 of the first embodiment comprises a cylindrical hollow body 12 tightly held by a holder 14. Designated by numeral 16 is a ring connector which is screwed on the hollow body 12 to assure tight connection between the hollow body 12 and the holder 14. The hollow body 12 has a longitudinally extending through hole which consists of a larger diameter section and a smaller diameter section. Screwed into the through hole of the hollow body 12 is a weft inserting body 18 which has a longitudinally extending passage 20 (or first weft inserting hole A) through which a weft yarn W is to be passed. The entrance of the passage 20 is formed into a frustoconical shape for achieving easy and reliable insertion of the weft yarn thereinto. As shown, the weft inserting body 18 includes a large diameter section preferably screwed to the larger diameter section of the hollow body through hole, a medium diameter section spacedly disposed within the remaining part of the larger diameter section of the hollow body through hole, and a smaller diameter section spacedly disposed within the smaller diameter section of the hollow body through hole. With this construction, there are formed mutually-communicating first and second tubular spaces 22 and 24 around the medium and smaller diameter sections of the weft inserting body 18, respectively. As shown, the smaller diameter section of the weft inserting body 18 is so positioned as to leave a considerable space 25 between the tip thereof and the exit of the smaller diameter section of the through hole of the hollow body 12. Equally spaced air stabilizers 26 are provided on the medium diameter section of the weft inserting body 18.

The cylindrical hollow body 12 is formed about the outer surface thereof with an annular groove 28 which communicates with the first tubular space 22 through a plurality of radial holes 30 formed in the hollow body 12. The annular groove 28 is connected to an air supply source (not shown) through an opening 32 formed in the holder 14, so that pressurized air from the air source is supplied to the groove 28 and thus to the second tubular space 24. With this construction, there is formed, around the tip of the smaller diameter section of the weft inserting body 18, a so-called air jet opening B from which the pressurized air is ejected or jetted toward the hole 25.

A tubular body 34 having a longitudinally extending through hole 36 is connected to the hollow body 12 in a manner to coaxially extend therefrom. As shown, the connection between them is such made that a sleeve-shaped tip portion of the hollow body 12 is snugly received in an enlarged entrance section of the tubular body through hole 36. Designated by numeral 38 is a coupler for securing the tubular body 34 to the hollow body 12. It is to be noted that the hole 25 of the hollow body 12 and the hole 36 of the tubular body 34 constitute a second weft inserting hole C which will be described hereinafter.

As shown, the hole 36 of the tubular body 34 has at its upstream part a first section 36*a* which has the same diameter as that of the hole 25 of the hollow body 12, and at its downstream part a second section 36*b* which has a larger diameter than the first section 36*a*. Designated by numeral 40 is a stepped portion from which the second section 36*b* extends.

The operation of the weft picking device will now be described.

During weft yarn picking, pressurized air from the air supply source is intermittently supplied to the second tubular space 24 through the annular groove 28, the radial holes 30, the first annular space 22 and the air stabilizers 26. The pressurized air thus reaching the second tubular space 24 is ejected or jetted from the air jet opening B toward the second weft inserting hole C. With this air jet, the weft yarn W in the first weft inserting hole A is drawn downstream toward the second weft inserting hole C.

While flowing through the through hole 36 of the tubular body 34, the air is subjected to expansion at the second section 36*b* because of its enlarged construction, so that the air velocity at that section is considerably decreased, there by supressing excess air acceleration, resulting in the ratio of the weft yarn velocity at the exit of the hole 36 to that at the entrance of the hold being considerably decreased. Since the velocity reduction of the weft yarn W in the second weft inserting hole C is gradually or smoothly made, the undesired slack of the weft yarn does not occur. It has been observed that two other undesirable phenomena, the untwisting of the weft yarn and the back flow of air, hardly occur.

Figure 2:
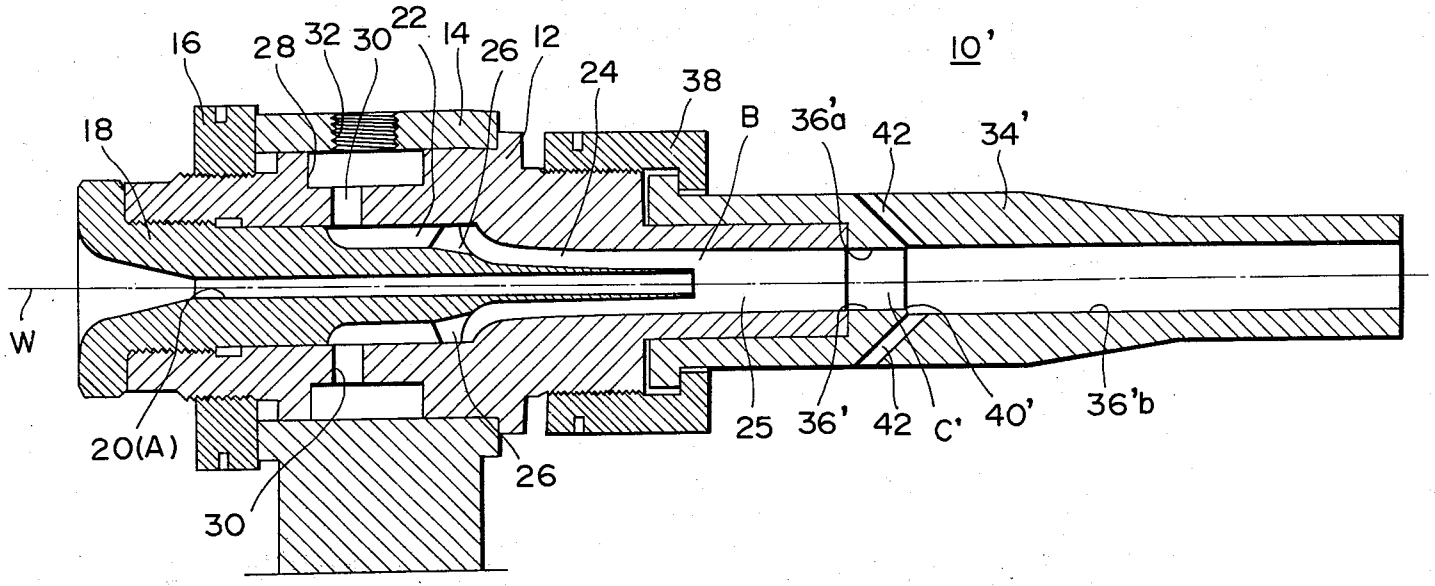
FIG. 2 is a view similar to FIG. 1, but showing a second embodiment of the present invention.

Referring to FIG. 2, there is shown a second embodiment of the present invention. The nozzle 10' of this embodiment has substantially the same construction and parts as those of the first embodiment except for the construction of the tubular body 34'. As shown in the second embodiment, a plurality of air introducing holes 42 are formed in the tubular body 34' in a manner to diagonally extend from the stepped portion 40' to the other surface of the body 34'. Each hole 42 is inclined upstream with respect to the axis of the second weft inserting hole C'. With this construction, the energy loss of air caused by air vortex appearing at the stepped portion 40' is minimized. In fact, during the air flow through the hole 36', there is produced a negative pressure in the hole 36', so that surrounding air is sucked through the holes 42 into the hole 36' to suppress generation of undesirable vortex flow. With the air introducing holes 42, the amount of air flow is increased thereby increasing the traction force applied to the weft yarn W travelling through the nozzle 10'.

Figure 3:
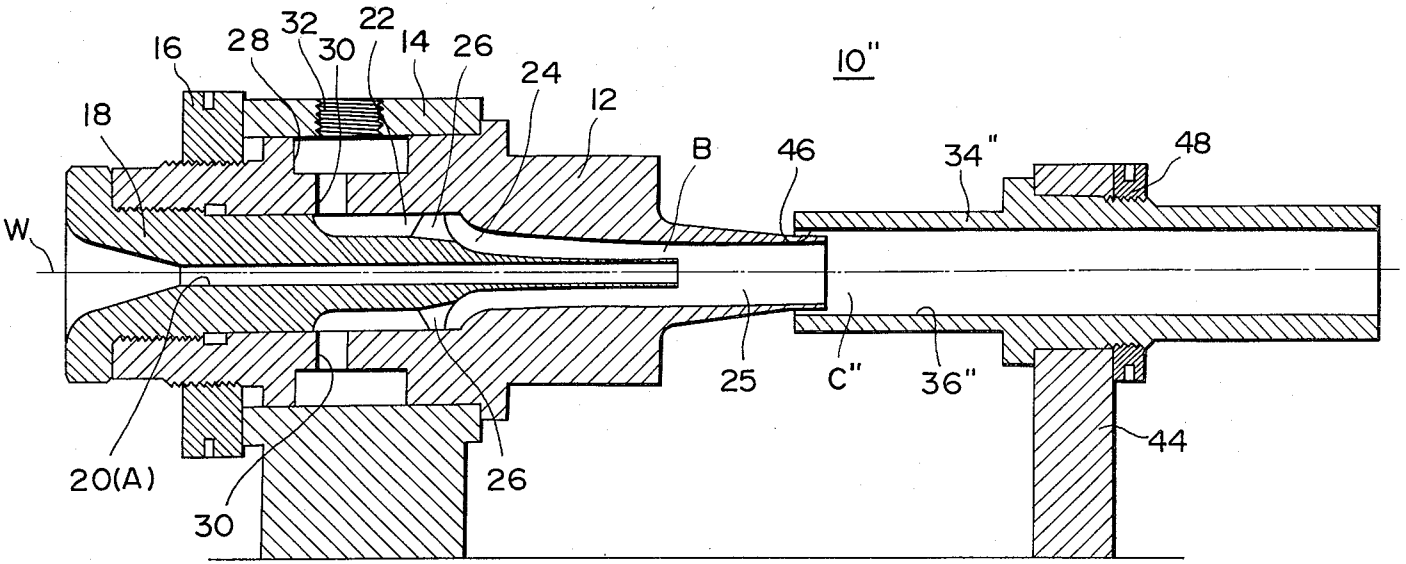
FIG. 3 is a view similar to FIG. 1, but showing a third embodiment of the present invention.

Referring to FIG. 3, there is shown a third embodiment of the present invention. The nozzle 10'' of this embodiment is a modification of the nozzle 10' of the second embodiment. In the third embodiment, a separate tubular body 34'' having a straight through hole 36'' is tightly held by a holder 44. Designated by numeral 48 is a ring connector for securing the tubular body 34'' to the holder 44. As shown, the through hole 36'' of the tubular body 34'' has throughout the whole length thereof a uniform diameter larger than that of the smaller diameter section of the hollow body 12. The sleeve-shaped tip portion of the hollow body 12 is spacedly disposed in the entrance of the tubular body's through hole 36'', leaving an annular clearance 46 therebetween. It is to be noted that the hole 25 of the hollow body 12 and the hole 36'' of the tubular body 34'' constitute the second weft inserting hole C''. With this construction, substantially the same effect as that of the second embodiment is achieved.

What is claimed is:

1. A weft inserting nozzle for an air jet type weaving loom, comprising:

a weft inserting body having therein a weft inserting first hole through which a weft yarn is adapted to pass, and an exit portion;

a hollow body having a bore coaxially disposed about said weft inserting body to define around said exit portion an annular air jet opening from which pressurized air is ejected downstream for drawing the weft yarn out of said weft inserting body;

a tubular body coaxially aligned with and connected to the bore in said hollow body to define a coaxial weft inserting second hole extending downstream from said annular air jet opening, said second hole having an upstream first section and a downstream second section, each of said sections having a uniform diameter throughout its length, the diameter of said second section being greater than that of said first section so that a stepped portion is defined between said first and second sections;

said tubular body having a plurality of air holes extending therethrough and connecting said second section to a source of air, each of said plurality of air holes extending from said stepped portion radially outwardly and obliquely in an upstream direction.

* * * * *